US009506303B2

(12) United States Patent
Forbes et al.

(10) Patent No.: US 9,506,303 B2
(45) Date of Patent: Nov. 29, 2016

(54) METHOD AND APPARATUS FOR PIPE PICKUP AND LAYDOWN

(71) Applicant: VEKTOR LIFT, LLC, Broussard, LA (US)

(72) Inventors: Steven Cory Forbes, Broussard, LA (US); Alex Joseph Saizon, Broussard, LA (US)

( * ) Notice: Subject to any disclaimer, the term of this patent is extended or adjusted under 35 U.S.C. 154(b) by 0 days.

(21) Appl. No.: 14/658,959

(22) Filed: Mar. 16, 2015

(65) Prior Publication Data

US 2015/0259992 A1 Sep. 17, 2015

Related U.S. Application Data

(60) Provisional application No. 61/954,112, filed on Mar. 17, 2014.

(51) Int. Cl.
*E21B 19/15* (2006.01)

(52) U.S. Cl.
CPC ..... *E21B 19/155* (2013.01)

(58) Field of Classification Search
CPC ..... E21B 19/155
USPC ..... 414/22.51–22, 59, 22.61–22, 69, 414/745.4–745.6
See application file for complete search history.

(56) References Cited

U.S. PATENT DOCUMENTS 3,810,553 A * 5/1974 Crocker ..... E21B 19/155 414/22.61
4,386,883 A * 6/1983 Hogan ..... E21B 19/155 414/22.61
4,718,805 A * 1/1988 Becker ..... E21B 19/155 175/85
9,080,397 B2 * 7/2015 Ludwig ..... E21B 19/14
2005/0152772 A1 * 7/2005 Hawkins ..... E21B 19/155 414/22.54
2007/0286708 A1 * 12/2007 Smith ..... E21B 19/155 414/22.58
2009/0127001 A1 * 5/2009 Felt ..... E21B 19/155 175/85
2009/0232624 A1 * 9/2009 Orgeron ..... E21B 19/155 414/22.55
2011/0200412 A1 * 8/2011 Orgeron ..... E21B 19/087 414/22.55
2013/0089393 A1 * 4/2013 Guillory, Jr. ..... E21B 19/155 414/22.61
2013/0251491 A1 * 9/2013 Ludwig ..... E21B 19/155 414/745.8
2013/0336747 A1 * 12/2013 Hilton ..... E21B 19/14 414/22.61
2013/0343837 A1 * 12/2013 Flusche ..... B65G 47/82 414/22.58
2013/0343858 A1 * 12/2013 Flusche ..... E21B 7/026 414/800
2015/0010377 A1 * 1/2015 Hilton, Jr. ..... E21B 19/14 414/22.54

(Continued)

FOREIGN PATENT DOCUMENTS

CA 2306061 A1 * 10/2001 ..... B60P 3/00
CA 2419885 A1 * 8/2003 ..... E21B 19/155
CA 2444446 A1 * 4/2005 ..... E21B 19/155

(Continued)

*Primary Examiner* — Jeanette E Chapman
(74) *Attorney, Agent, or Firm* — Ted M. Anthony

(57) ABSTRACT

A trailer mounted system for delivering a section of pipe or other tubular from a rack or staging area to a rig floor, or vice versa. A central beam is pivotally mounted to a trailer assembly and can be selectively raised or lowered relative the underlying trailer assembly. An extender beam, telescopically mounted to the central beam, can be selectively extended or retracted, while a trough member attached to the beams can be selectively partially rotated. Lateral pipe support rails can provide a base for selectively directing a pipe section towards or away from the trough. A safety system prevents inadvertent rotation of the trough when loaded with a section of pipe or other tubular, as well as inadvertent extension of the trough when rotated.

3 Claims, 12 Drawing Sheets

(56) References Cited

U.S. PATENT DOCUMENTS

2015/0275595 A1* 10/2015 Cheeseman ..... E21B 19/15
175/52
2015/0376952 A1* 12/2015 McCarthy ..... E21B 10/322
175/57

FOREIGN PATENT DOCUMENTS

DE WO 2011120627 A2 * 10/2011 ..... E21B 19/15
EP 0176335 A1 * 4/1986 ..... B60P 1/025
JP EP 1327786 A1 * 7/2003 ..... F16C 29/0607
WO WO 2006020142 A1 * 2/2006 ..... B66C 1/10

* cited by examiner

METHOD AND APPARATUS FOR PIPE PICKUP AND LAYDOWN

CROSS REFERENCES TO RELATED APPLICATION

Priority of U.S. Provisional Patent Application Ser. No. 61/954,112, filed Mar. 17, 2014, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a pipe pickup and laydown assembly for use on work sites, such as where a drilling rig, work over rig and/or snubbing unit is deployed. More particularly, the present invention pertains to a hydraulic powered, pipe pickup and laydown assembly for use in safely and efficiently delivering a tubular from a ground surface to a "V-door" of a drilling rig, or vice versa.

2. Brief Description of the Related Art

Drilling of oil and/or gas wells typically involves the drilling of a well bore to a desired depth in the earth's crust. At certain intervals, relatively large pipe—commonly referred to as "casing"—is installed into a well bore and cemented in place. Such casing, and/or a cement sheath surrounding the exterior surface of such casing, provides structural integrity to said well bore, while isolating formations penetrated by said well bore from each other. Additionally, after a well has been fully equipped with casing, production tubing can also be installed within said well bore (within the inner bore of said casing).

During pipe installation operations, casing, tubing or other pipe is typically inserted into a well bore in a number of separate sections of substantially equal length referred to as "joints." The joints, which generally include threaded connections at both ends, are typically joined end-to-end at the earth's surface (typically from a drilling rig) in order to form a substantially continuous "string" of pipe that reaches downward into a well.

Such pipe sections—which can typically be from 20 to 40 feet or more in length, several inches in diameter, and weigh several thousand pounds—generally must be transferred from a pipe rack or other staging area to the rig floor of a drilling rig. Thus, transferring said pipe sections from said pipe rack to said rig floor in a safe and efficient manner can be a complex and time consuming task. In conventional pickup and laydown operations, a section of pipe or other tubular good is frequently lifted via a cable hoist; sometimes a tag line is attached to the pipe section in order to control the movement of the tubular good.

In some cases, pipe is transferred from a pipe rack or other staging area to a drilling rig using partially-automated pipe handling equipment. Such conventional pipe handling equipment, commonly referred to as pipe "laydown" or "pickup" machines, can often be used to convey individual pipe sections to the vicinity of a rig floor where a strap (attached to a hoisting means) may then be employed to lift such section vertically above the floor. However, such conventional pipe handling assemblies are relatively large and heavy; such devices require a large amount of space (which is often at a premium on drilling rigs and pipe racks), and may require multiple trucks to deliver, position and install such equipment. Further, such conventional pipe handling equipment can be expensive to manufacture and operate, and can be overdesigned for smaller, lighter weight tubular goods.

Thus, there is a need for a safe, efficient and easily controlled method and apparatus for delivering pipe and other tubular goods from a pipe rack or other staging area to an inlet opening (typically a so-called "V door") of a drilling rig. The pipe transfer assembly should be relatively small and easy to transport, position and operate.

SUMMARY OF THE INVENTION

The present invention comprises an automated pipe pickup and laydown assembly. In a preferred embodiment, said automated pipe pickup and laydown assembly of the present invention comprises a relatively small and light-weight trailer mounted apparatus that can be easily moved to and from remote locations, such as well drilling sites, and positioned in and around said locations. By way of illustration, but not limitation, said automated pipe pickup and laydown assembly can have a height of approximately thirty-eight (38) feet, a weight capacity of approximately 1,200 lbs, and a side wind rating of up to eighty (80) miles per hour or more; however, it is to be observed that said pipe pickup and laydown assembly can have different dimensions and characteristics without departing from the scope of the present invention. Said automated pipe pickup and laydown can be beneficially transported and maneuvered without requiring specialized equipment.

The automated pipe pickup and laydown assembly of the present invention comprises a trailer frame assembly, as well as a central beam assembly pivotally mounted to said trailer frame assembly. In a preferred embodiment, said trailer frame assembly of the present invention comprises a plurality—typically three (3)—of retractable or removable support stands. Said support stands are equidistantly spaced along the base of said trailer frame assembly; although other configurations can be employed, in preferred embodiment a first support stand is disposed at a front end, a second support stand is disposed at a rear end, and a third support stand in a middle of said trailer frame assembly of the present invention. At least one wheel assembly can be beneficially located between said support stands of the present invention for moving said trailer frame assembly.

The automated pipe assembly of the present invention further comprises a plurality of movable pipe support rails. Said pipe support rails are pivotally attached to said trailer frame assembly, and can be raised or lowered in a direction that is generally perpendicular to the longitudinal axis of said trailer assembly. Said pipe support rails can provide a base for selectively directing a pipe section towards or away from said trailer frame assembly.

As noted above, said central beam assembly has a first end, a second end and a length. Said first end of said central beam assembly is pivotally mounted to said trailer frame assembly, while said second end of said central beam can be selectively raised and lowered relative to said trailer frame assembly. Said central beam assembly of the present invention further comprises an extendable boom member, as well as at least one cylinder for extending said boom member. A trough member is mounted to the upper surface of said extendable boom member, and can at least partially rotate about its longitudinal axis. In a preferred embodiment, an automated trough dump assembly permits selective rotation of said trough member, while at least one safety switch prevents inadvertent extension of said boom member and/or rotation of said trough member.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

The present invention comprises an automated pipe pickup and laydown assembly that can be beneficially used for transferring pipe sections and other tubular goods between pipe racks/staging areas, and a drilling rig entry point (typically, and opening in a rig derrick commonly referred to as a V-door). In a preferred embodiment, said automated pickup and laydown assembly of the present invention is a relatively small and light-weight trailer-mounted apparatus that can be easily moved to and from remote locations. Once on a location, said automated pickup and laydown assembly can be quickly and efficiently maneuvered on and around a work site and deployed in an optimum location for conducting pipe-related operations.

Figure 1:
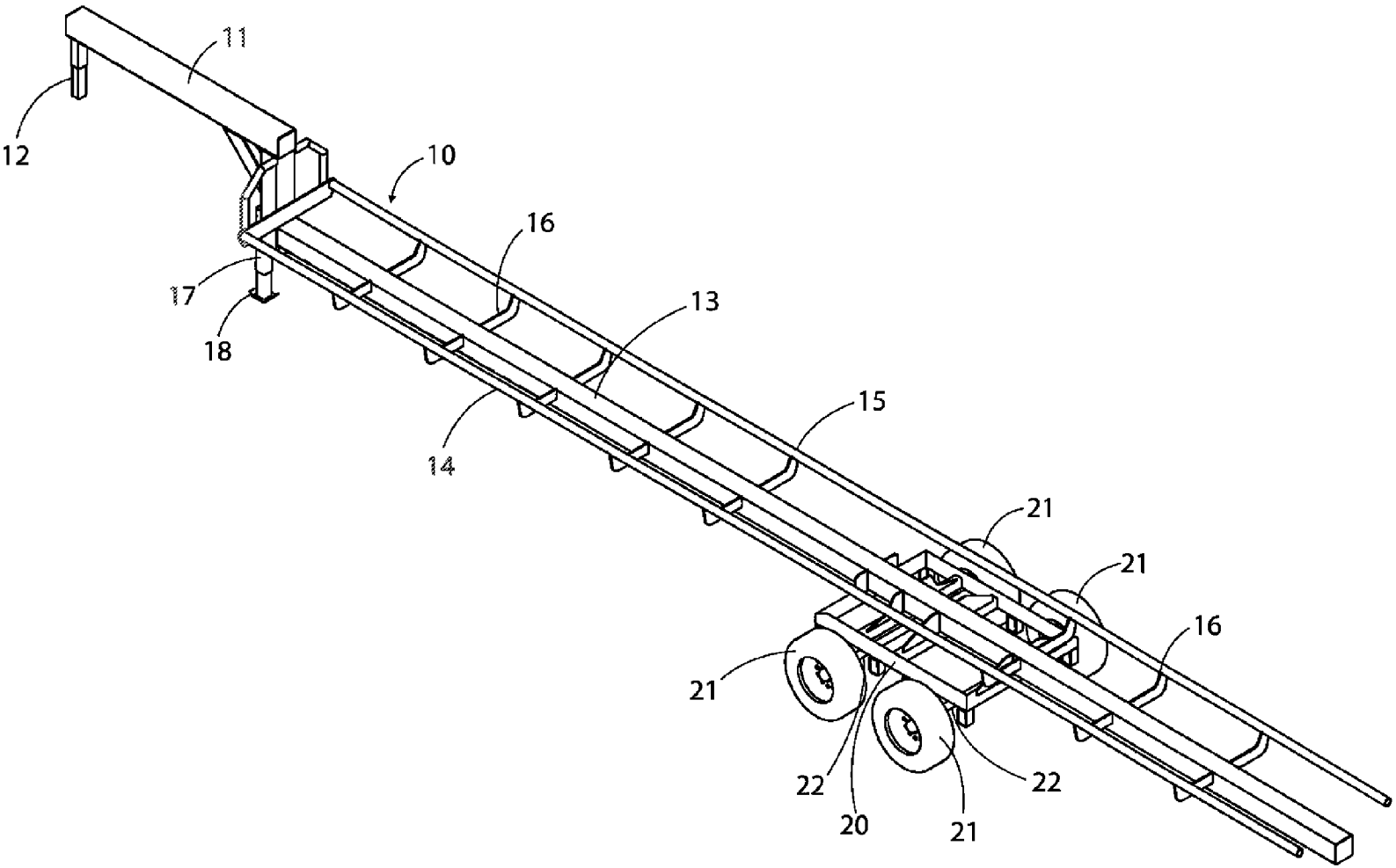
FIG. 1 depicts an overhead perspective view of a portion of a trailer frame assembly of the automated pipe pickup and laydown assembly of the present invention.

Referring to the drawings, FIG. 1 depicts an overhead perspective view of a portion of a trailer frame assembly 10 of the automated pipe pickup and laydown assembly 100 of the present invention having certain components removed for illustration purposes. In a preferred embodiment, said trailer frame assembly 10 generally comprises elongate central base member 13, first side rail 14 and second side rail member 15. A plurality of lateral support braces 16 connect said central base member 13 to said side rails 14 and 15.

Still referring to FIG. 1, a trailer hitch member 11 is provided at one end of said trailer frame assembly 10. Although different trailer hitch and/or connection assemblies can be utilized without departing from the scope of the present invention, as depicted in FIG. 1 said trailer hitch member 11 comprises a "goose neck"-type hitch assembly having hitch connector 12 and adjustable stand member 17. Said adjustable stand member 17 further comprises base pad 18, and can be adjusted to provide a stable base to trailer frame assembly 10 when not in transit.

Trailer frame assembly 10 further comprises wheel mount chassis member 20 which is connected to said trailer frame assembly 10, such as via central base member 13. Wheels 21 are rotatably connected to axles 22 which, in turn, are connected to said wheel mount chassis member 20. Trailer frame assembly 10 can be connected to a vehicle, and easily and efficiently pulled to and from remote locations. Although a vast array of different vehicles can be used for this purpose, it is to be observed that said trailer frame assembly 10 can be connected to, and pulled by, a conventional ¾ ton truck.

Figure 2:
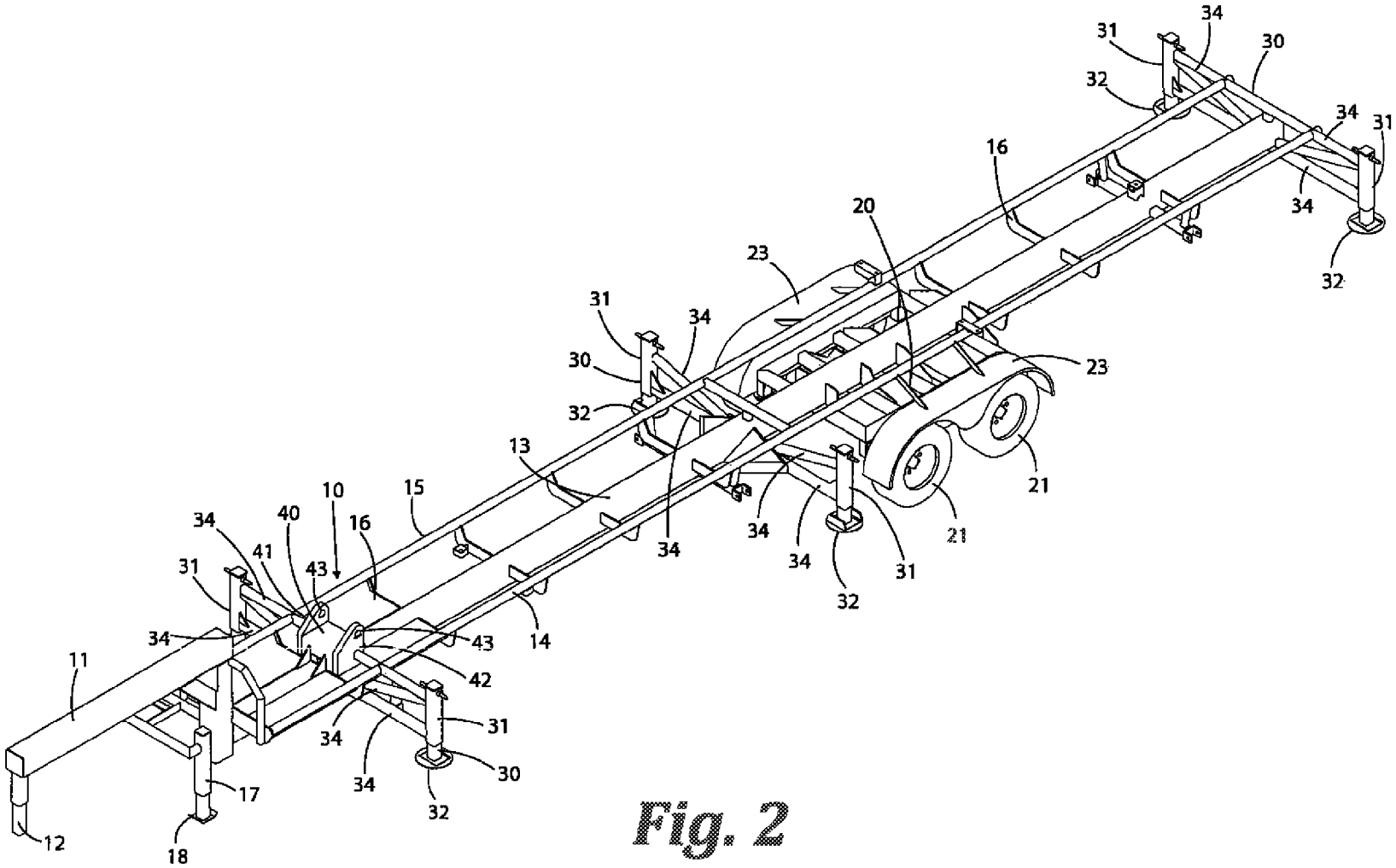
FIG. 2 depicts an overhead perspective view of a trailer frame assembly of the automated pipe pickup and laydown assembly of the present invention in a partially deployed configuration.

FIG. 2 depicts an overhead perspective view of trailer frame assembly 10 of the automated pipe pickup and laydown assembly of the present invention in a partially deployed configuration. As noted above, said trailer frame assembly 10 generally comprises elongate central base member 13, first side rail 14, second side rail member 15, and a plurality of lateral support braces 16 connecting said central base member 13 to said side rails 14 and 15. Trailer hitch member 11 comprises a "goose neck"-type hitch assembly with hitch connector 12 and adjustable stand member 17 having base pad 18. Wheel mount chassis member 20 is connected to central base member 13 having wheels 21, while fenders 23 cover said wheels 21.

Still referring to FIG. 2, trailer frame assembly 10 of the present invention further comprises a plurality of support stand assemblies 30 generally comprising lateral support members 34 beneficially connected to central base member 13, as well as telescoping upright stand members 31 having base pads 32. In a preferred embodiment, a first such support stand assembly is positioned near a first end of said trailer frame assembly, a second support stand is positioned near a second end of said trailer frame assembly, and a third such support stand is positioned near the midpoint along the length of said trailer frame assembly.

Trailer frame assembly 10 further comprises beam mounting bracket 40. Said beam mounting bracket 40 is fixedly attached to central base member 13 and forms a clevis-type bracket. Said beam mounting bracket 40 further comprises substantially planar and parallel side members 41 and 42. Aligned bores 43 extend through said side members 41 and 42.

Figure 3:
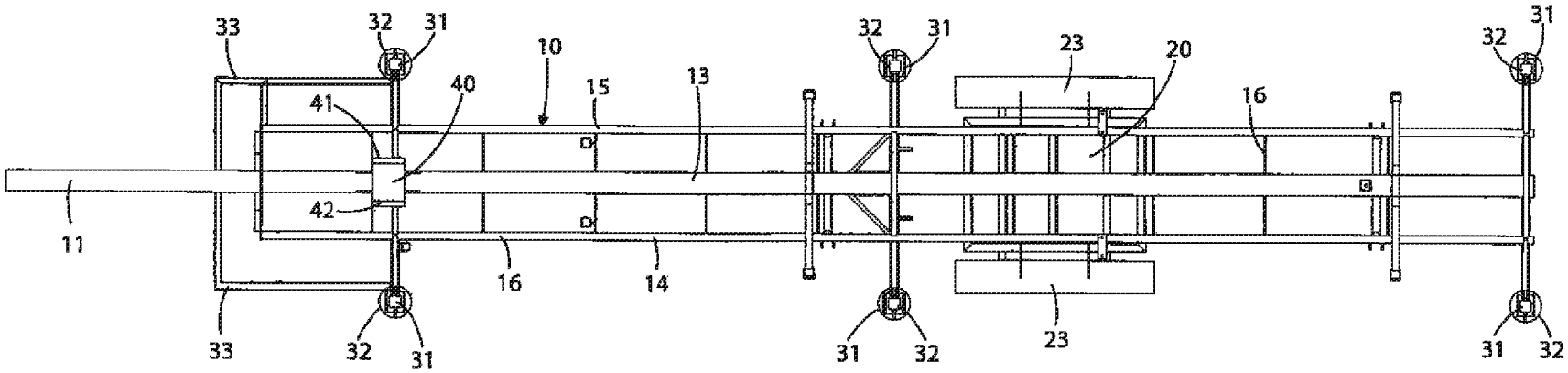
FIG. 3 depicts an overhead view of a trailer frame assembly of the automated pipe pickup and laydown assembly of the present invention in a partially deployed configuration.

FIG. 3 depicts an overhead view of trailer frame assembly 10 of the present invention in a partially deployed configuration. Components depicted in FIG. 3 have the same reference numerals as like components depicted in FIG. 2. Additionally, trailer frame assembly 10 further comprises optional power pack support base 33, described in more detail below. Beam mounting bracket 40, having substantially planar and parallel side members 41 and 42, is fixedly attached to central base member 13.

Figure 4:
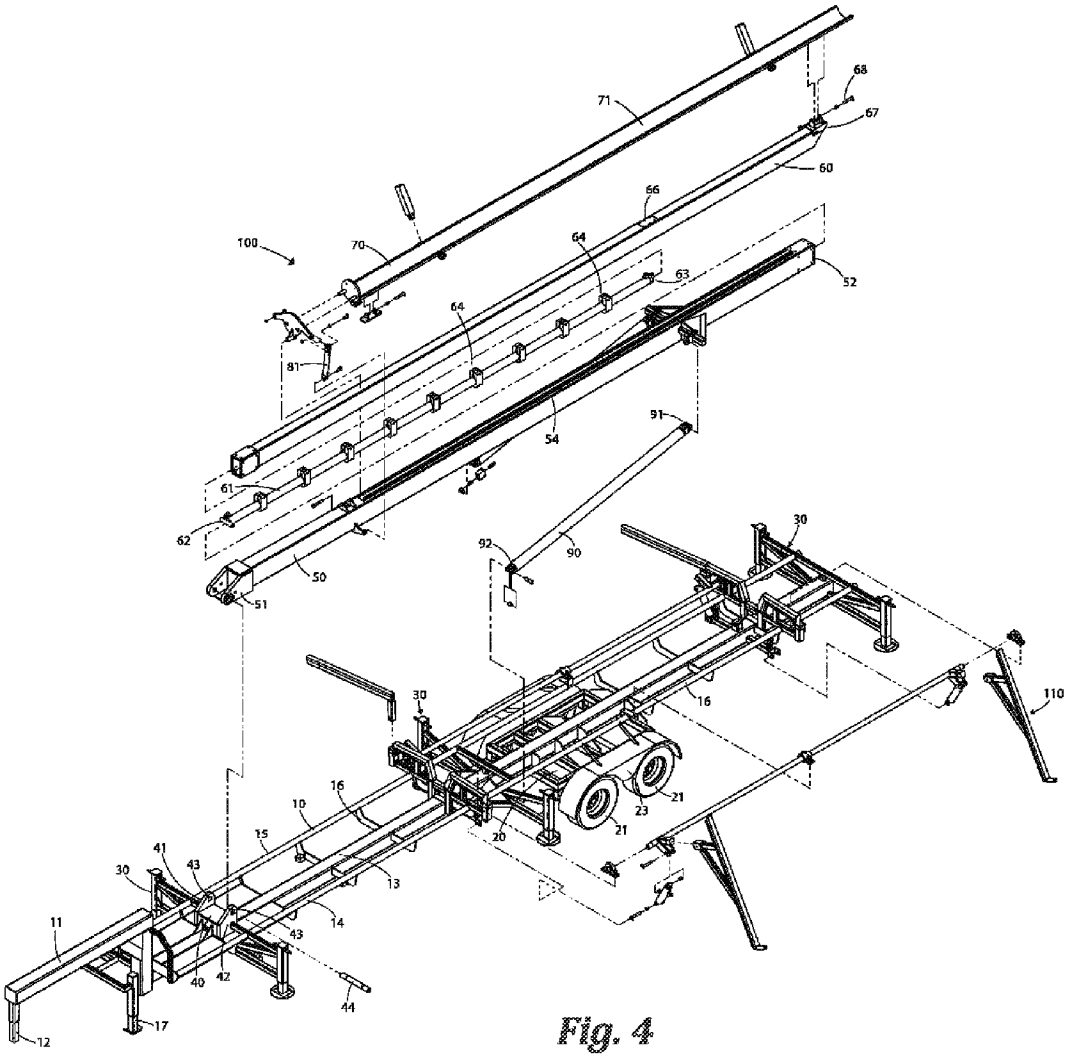
FIG. 4 depicts an exploded perspective view of the automated pipe pickup and laydown assembly of the present invention.

FIG. 4 depicts an exploded perspective view of automated pipe pickup and laydown assembly 100 of the present invention. Said automated pipe pickup and laydown assembly 100 comprises a trailer frame assembly 10, discussed in detail above, generally comprising elongate central base member 13, first side rail 14, second side rail member 15, and a plurality of lateral support braces 16 connecting said central base member 13 to said side rails 14 and 15. Trailer hitch member 11 has hitch connector 12 and adjustable stand member 17. Wheel mount chassis member 20 is connected to central base member 13 having wheels 21 and fenders 23 over said wheels 21.

When deployed, a plurality of support assemblies 30 generally provide a stable base on the ground or other substratum to prevent said automated pipe pickup and laydown assembly 100 from unwanted movement, such as wobbling or side-to-side tilting. Additionally, still referring to FIG. 4, an automated pipe rail assembly 110 (discussed in detail below) is deployed along one lateral side of said pipe pickup and laydown assembly 100.

Beam mounting bracket 40 is fixedly attached to central base member 13 and forms a clevis-type bracket having substantially planar and parallel side members 41 and 42, with aligned bores 43 extending therethrough. Partially hollow central beam member 50 having mounting collar 51 is pivotally mounted to said beam mounting bracket using mounting bolt 44 disposed through aligned bores 43.

Partially hollow extender beam 60 is telescopically and slidably disposed within a central bore of said substantially hollow central beam 50. At least one linear actuator—ideally a fluid powered cylinder 61—is disposed within said inner bore of said central beam member 50, as well as a portion of said extender beam 60; actuation of said cylinder 61 causes said extender beam 60 to extend and/or retract relative to said central beam member 50.

In a preferred embodiment, fluid powered cylinder 61 has a first end 62 (such as at the base of a barrel of a hydraulic cylinder), a second end 63 (such as at the end of a movable piston member), and a plurality of support spacers 64 disposed in spaced relationship along the outer surface of said cylinder 61. Said support spacers 64 are placed along the length of said cylinder 61 to prevent said cylinder from bowing or sagging along its length, particularly while disposed within the inner bore of substantially hollow central beam 50. In a preferred embodiment, said support spacers 64 comprise ultra-high-molecular-weight polyethylene ("UHMW"); however, it is to be observed that said support spacers 64 may be constructed of other suitable material without departing from the scope of the present invention.

First end 62 of cylinder 61 is anchored to central beam 50. As noted above, a portion of said cylinder 61 is received within a central bore of extender beam 60 which, in turn, is telescopically received within the internal bore of central beam 50. Second end 63 of cylinder 61 is anchored to extender bore 60 near cylinder anchor point 66. In this manner, extension of cylinder 61 (anchored at first end 62 to central beam 50) imparts axial force on extender beam 60, thereby causing said extender beam 60 to telescopically extend relative to central beam 50.

Trough member 70 having substantially concave upper surface 71 is connected to trough connection bracket 67 of extender beam 60 using pivot bolt 68. Said trough member 70 is disposed generally on the upper surface of central beam member 50, and is capable of traveling axially within track 54 extending along said upper surface of said central beam member 50. Specifically, when cylinder 61 is actuated and imparts axial force on extender beam 60, said extender beam 60 extends telescopically relative to central beam 50. As said extender beam 60 moves telescopically outward, trough member 70 (anchored at its distal end to trough connection bracket 67) rides within said track 54 along a portion of the length of central beam member 50.

Distal end 52 of central beam member 50, as well as extender beam 60 and trough member 70, can be selectively raised or lowered relative to trailer frame assembly 10. In a preferred embodiment, at least one linear actuator—ideally a fluid powered cylinder 90—is disposed on each side of automated pipe pickup and laydown assembly 100. A first end 91 of each cylinder 90 is pivotally attached to central beam member 50, while a second end 92 of each cylinder 90 is pivotally attached to trailer frame assembly 10.

Trough member 70 can be selectively rotated about its longitudinal axis. In a preferred embodiment, an automated trough rotation or "dump" assembly can partially rotate said trough member about its longitudinal axis. At least one linear actuator, such as fluid powered cylinder 81, can be used to partially rotate said trough member as discussed in detail below.

Figure 5:
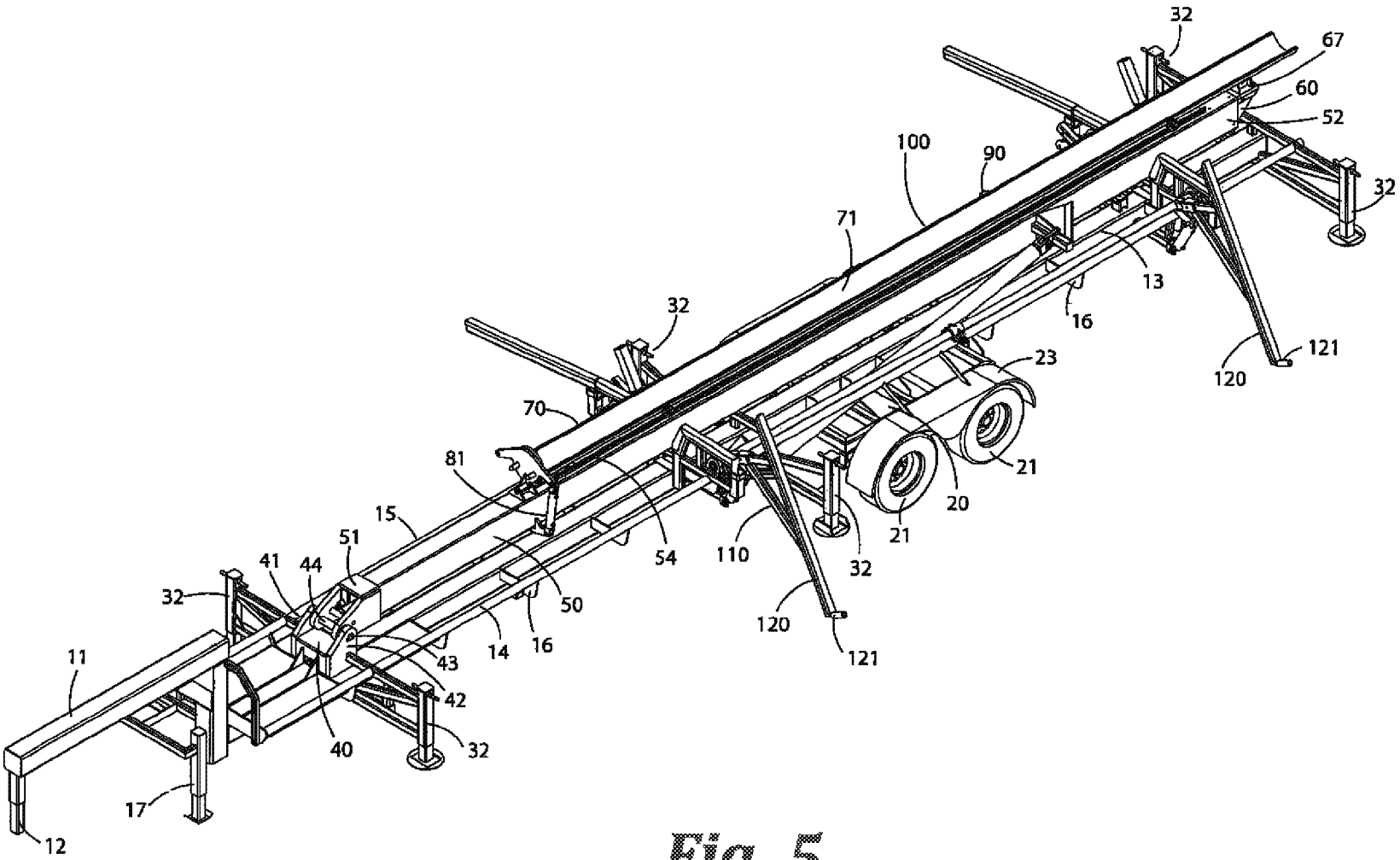
FIG. 5 depicts a side perspective view of the automated pipe pickup and laydown assembly of the present invention.

FIG. 5 depicts a side perspective view of automated pipe pickup and laydown assembly 100 of the present invention with central beam member 50 and (attached extender beam 60 and trough member 70) in a lowered or retracted configuration relative to trailer frame assembly 10.

Trailer frame assembly 10, discussed in detail above, generally comprising elongate central base member 13, first side rail 14, second side rail member 15, and a plurality of lateral support braces 16 connecting said central base member 13 to said side rails 14 and 15. Trailer hitch member 11 has hitch connector 12 and adjustable stand member 17. Wheel mount chassis member 20 is connected to central base member 13 having wheels 21 and fenders 23 over said wheels 21.

A plurality of support assemblies 30 can be deployed to provide a stable base on the ground or other substratum to prevent said automated pipe pickup and laydown assembly 100 from unwanted movement. Automated pipe rail assembly 110 (discussed in detail below) having rail members 120. Said rail members 120 are beneficially equipped with foot members 121.

Beam mounting bracket 40 is fixedly attached to central base member 13 and forms a clevis-type bracket having substantially planar and parallel side members 41 and 42, with aligned bores 43 extending therethrough. Partially hollow central beam member 50 having mounting collar 51 is pivotally mounted to said beam mounting bracket using mounting bolt 44 disposed through aligned bores 43. Partially hollow extender beam 60 is telescopically and slidably disposed within a central bore of said substantially hollow central beam 50.

Trough member 70 having substantially concave upper surface 71 is connected to trough connection bracket 67 of extender beam 60. Said trough member 70 is disposed generally on the upper surface of central beam member 50, and is capable of traveling axially within track 54 extending along said upper surface of said central beam member 50. Specifically, as said extender beam 60 moves telescopically outward relative to central beam member 50, trough member 70 (anchored at its distal end to trough connection bracket 67) rides within said track 54 axially along central beam member 50.

Distal end 52 of central beam member 50, as well as extender beam 60 and trough member 70, can be selectively raised or lowered relative to trailer frame assembly 10. In a preferred embodiment, at least one linear actuator—ideally a fluid powered cylinder 90—is disposed on each side of automated pipe pickup and laydown assembly 100. Trough member 70 can be selectively rotated about its longitudinal axis. In a preferred embodiment, an automated trough rotation or "dump" assembly can partially rotate said trough member about its longitudinal axis. At least one linear actuator, such as fluid powered cylinder 81, can be used to partially rotate said trough member 70.

Figure 6:
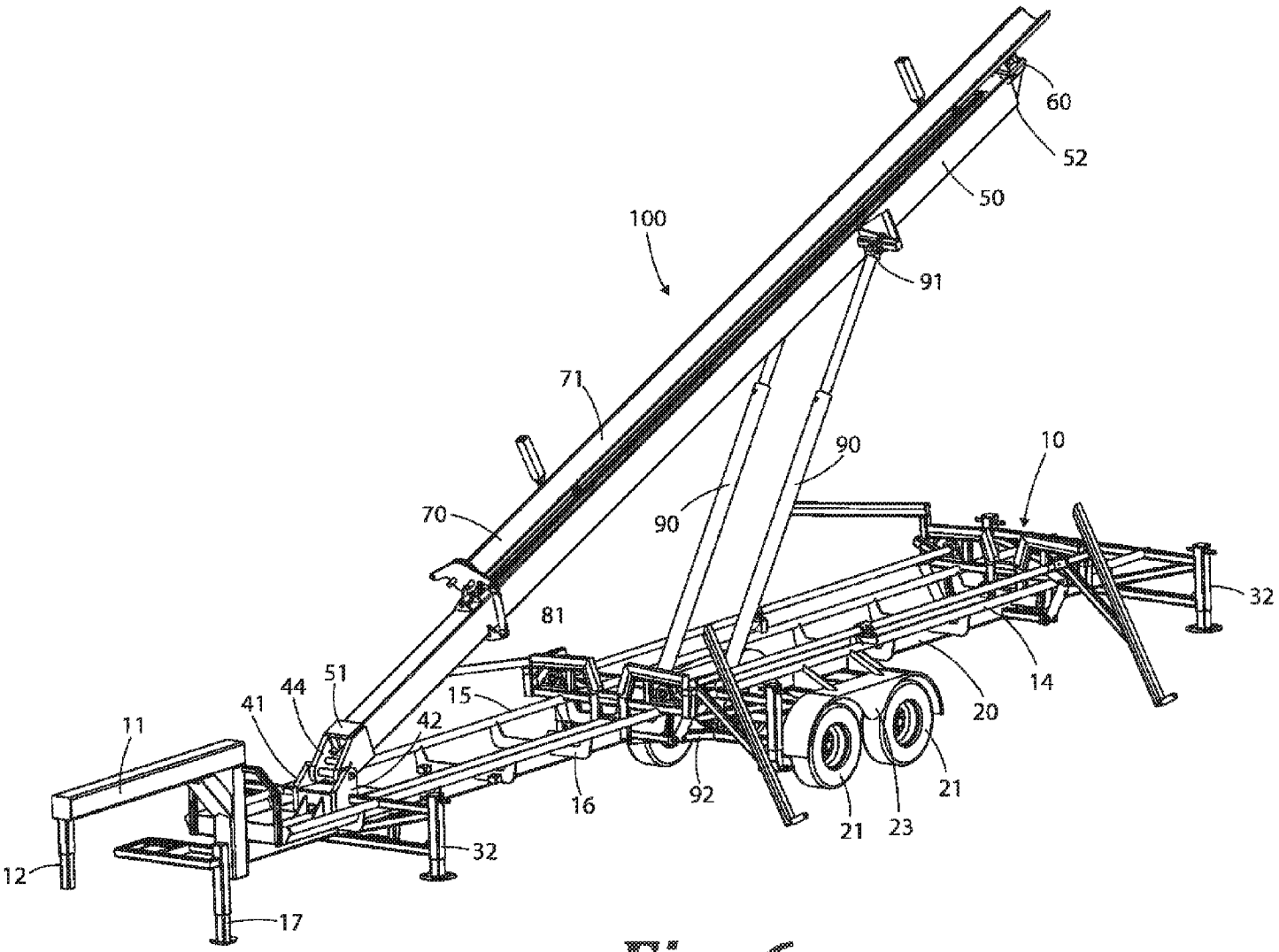
FIG. 6 depicts a side perspective view of the automated pipe pickup and laydown assembly of the present invention in a partially raised configuration.

FIG. 6 depicts a side perspective view of automated pipe pickup and laydown assembly 100 of the present invention with central beam member 50 and (attached extender beam 60 and trough member 70) in a partially raised configuration relative to trailer frame assembly 10. Components depicted in FIG. 6 have the same reference numerals as like components depicted in FIG. 5.

Still referring to FIG. 6, a fluid powered cylinder 90 is disposed on each side of automated pipe pickup and laydown assembly 100. A first end 91 of each cylinder 90 is pivotally attached to central beam member 50, while a second end of each cylinder 90 is pivotally attached to trailer frame assembly 10. Extension of said cylinders 90 causes distal end 52 of central beam member 50 to elevate away from trailer frame assembly 10, as beam mounting collar 51 pivots about pivot bolt 44 within beam mounting bracket 40.

Figure 7:
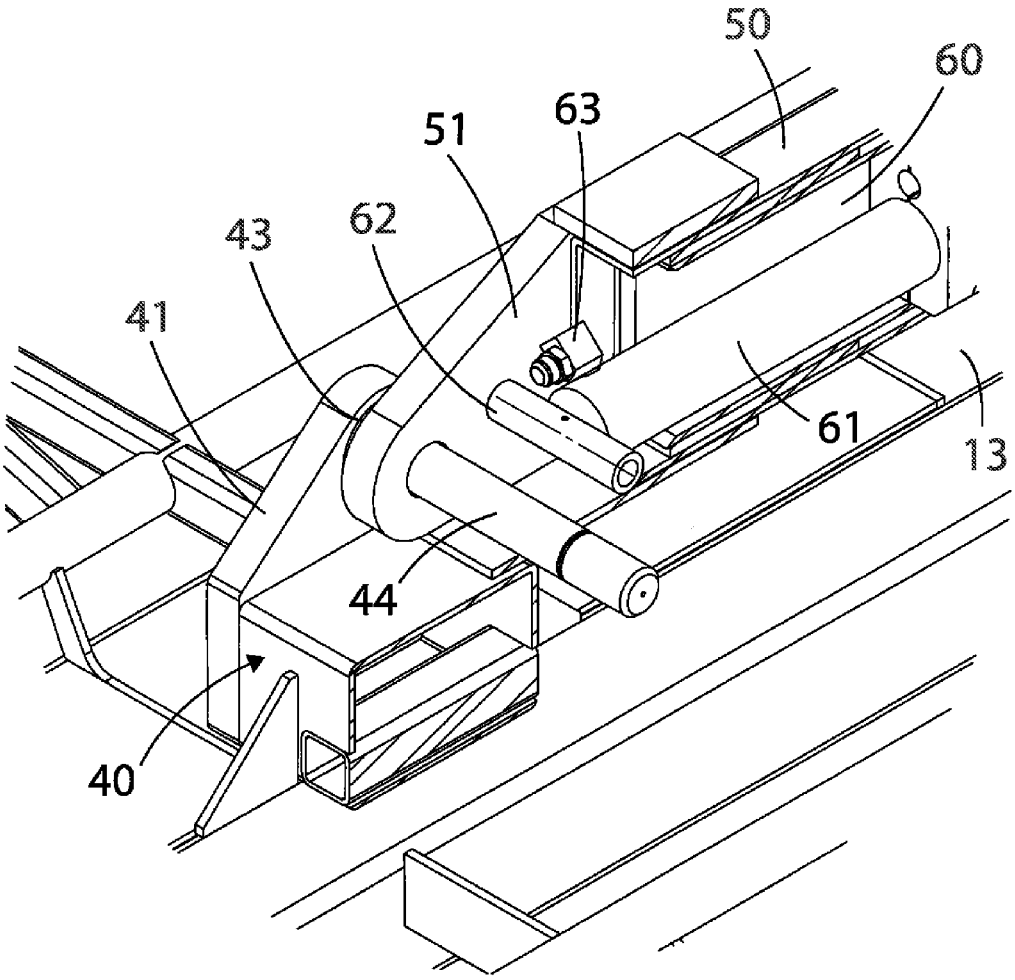
FIG. 7 depicts a perspective sectional view of a portion of the automated pipe pickup and laydown assembly of the present invention.

FIG. 7 depicts a perspective sectional view of a portion of the automated pipe pickup and laydown assembly of the present invention. Beam mounting bracket 40 is fixedly attached to central base member 13 and forms a clevis-type bracket having substantially planar side member 41 (as well as substantially planar and parallel side wall member 42, not visible in FIG. 7). Partially hollow central beam member 50 having mounting collar 51 is pivotally mounted to said beam mounting bracket using mounting bolt 44 disposed through bore 43 of side member 41 (and mating side will member 42, not visible in FIG. 7).

Extender beam 60 is telescopically and slidably disposed within the inner bore of substantially hollow central beam 50. Hydraulic cylinder 61 has a first end 62 attached to beam mounting collar 51, as well as hydraulic fluid fitting 63 for supplying hydraulic fluid to said cylinder 61. Although not visible in FIG. 6, referring back to FIG. 4, the distal end 63 of said cylinder 61 is attached to said extender beam 60. As such, actuation of said cylinder 61 causes said extender beam 60 to telescopically extend and/or retract relative to said central beam member 50.

Figure 8:
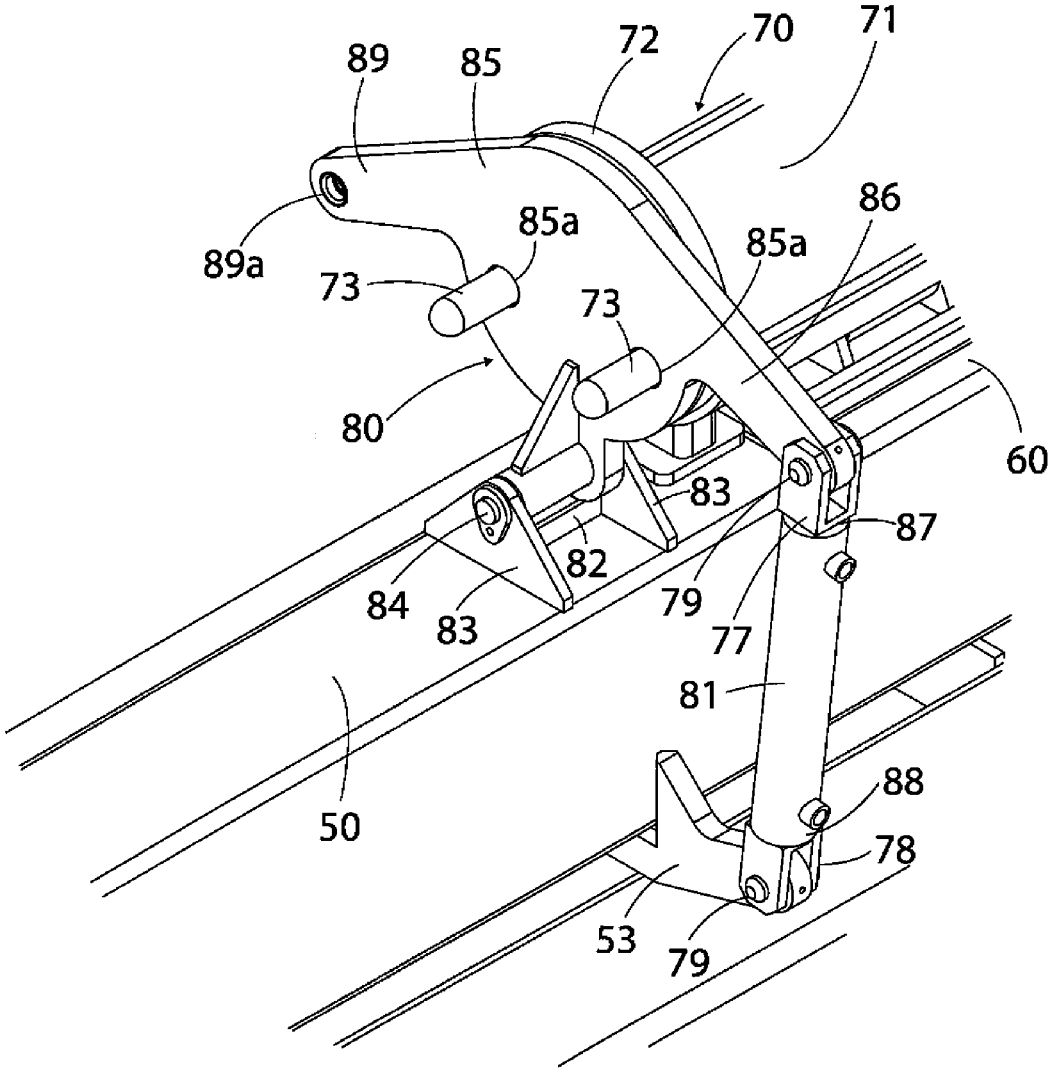
FIG. 8 depicts perspective view of a portion of the trough rotation or "dump" assembly of the automated pipe pickup and laydown assembly of the present invention.

FIG. 8 depicts perspective view of a portion of trough rotation or "dump" assembly 80 of automated pipe pickup and laydown assembly 100 of the present invention. Mounting bracket 82 is fixedly attached to central beam 50, and forms a clevis-type bracket having substantially planar and parallel side members 83. Kick plate 85 is pivotally mounted within said mounting bracket 82 using mounting bolt 84 disposed through aligned bores in parallel side members 83, while pins 73 of trough member 70 are removably received within holes 85*a* of kick plate 85. Said kick plate 85 further defines lateral extension arms 86 and 89.

Upper end 87 of trough dump assembly cylinder 81 is attached to a lateral extension arm 86 using upper clevis bracket 77 and pivot pin 77*a*, while lower end 88 of trough dump assembly cylinder 81 is connected to lower cylinder mounting bracket 53 using lower clevis bracket 78. Although not visible in FIG. 8, said mounting bracket extends laterally from the opposite side of central beam member 50, thereby providing a similar anchor point on the opposite of said central beam member 50, generally below lateral arm extension 89 of kicker plate 85.

Actuation of fluid powered cylinder 81 imparts linear force on lateral extension arm 86 which acts as a lever, causing kicker plate 85 to rotate about pivot bolt 84. Torque forces are, in turn, imparted from said kicker plate 85 to pins 73 and attached trough member 70. In this manner, actuation of fluid powered cylinder 81 can be used to selectively rotate said trough member 70 a partial revolution about its longitudinal axis.

It is to be observed that the direction of rotation of said trough member 70 can be easily and conveniently reversed with minimal effort and without requiring specialized tools or equipment. Specifically, cylinder 81 can be removed from lower mounting bracket 53 and kick plate lateral extension arm 86. Said cylinder can be moved to the opposite lateral side of central beam member 50. Lower clevis bracket 78 can be secured to mounting bracket 53 on said opposite side (not visible in FIG. 8), while upper clevis bracket 77 can be attached to lateral extension arm 89 via mounting bore 89*a*.

Referring back to FIG. 5, extender beam 60 can be extended telescopically outward relative to central beam member 50. When this occurs, trough member 70 (anchored at its distal end to trough connection bracket 67) rides within said track 54 axially along central beam member 50. Referring back to FIG. 8, as trough member 70 moves away from kicker plate 85 axially along the length of central beam member 50, pins 73 of trough member 70 slide through holes 85*a* in kicker plate 85. When said pins 73 are no longer received within said holes 85*a*, kicker plate 85 cannot engage said pins 73 and, as a result, movement of said kicker plate 85 will not result in trough member 70 being rotated. Thus, said trough member 70 cannot be inadvertently rotated when said extender beam 60 is extended and pins 73 are disengaged from kicker plate 85; actuation of cylinder 81 will simply result in movement of kicker plate 85, without any corresponding movement or rotation of disengaged trough 70.

Similarly, a safety system can prevent inadvertent rotation or dumping of trough member 70, such as when central beam member 50 is elevated off of trailer frame assembly 10. A sensor (such as, for example, a button or compression actuated switch) can be located under or otherwise in proximity to central beam member 50; said sensor is capable of sensing when central beam member 50 (including, without limitation, distal end 52 thereof) is raised from a "neutral" position at or on trailer assembly 10. In a preferred embodiment, said sensor is connected to a valve that supplies power to dump assembly 80 (including, without limitation, cylinder 81). As such, when said sensor recognizes that central beam member 50 is elevated off of said trailer assembly 10, said sensor actuates said valve, thereby preventing actuation of cylinder assembly 81 and, in turn, rotation of trough member 70.

Figure 9:
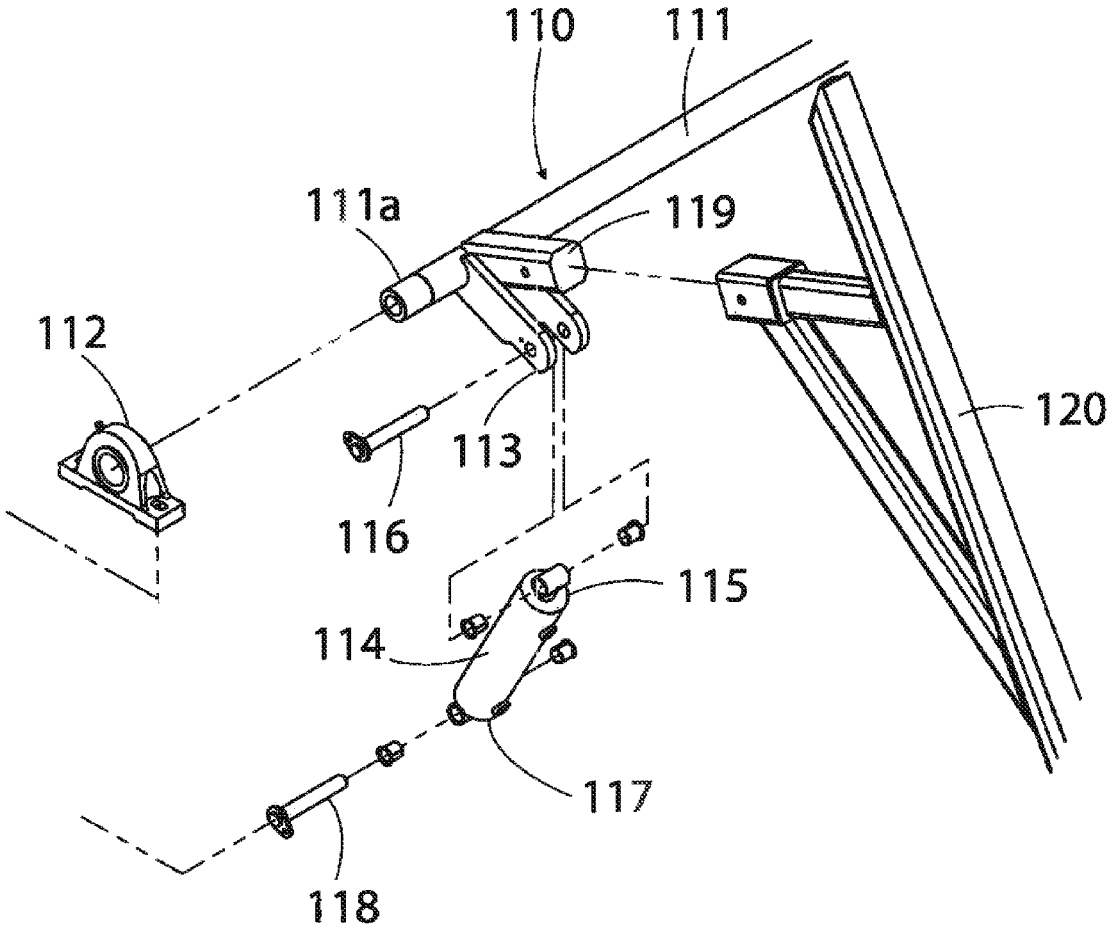
FIG. 9 depicts perspective view of a portion of a pipe rail assembly of the automated pipe pickup and laydown assembly of the present invention.

FIG. 9 depicts a perspective view of a portion of a pipe rail assembly 110 of the automated pipe pickup and laydown assembly of the present invention. Mounting bracket 112 is mounted to trailer frame assembly 10, while lateral end 111*a* of mounting cylinder 111 is rotatably received within said mounting bracket 112. Upper end 115 of actuation cylinder 114 is connected to clevis bracket 113 of said mounting cylinder 111 using upper pin 116, while lower end 117 of actuation cylinder 114 is mounted to stationary trailer frame assembly 10. Mounting block extension 119 extends laterally outward from mounting cylinder 111, while pipe rail member 120 is connected to said mounting block assembly 119. Referring back to FIG. 5, said pipe rail members 120 have retaining foot members 121 at their distal or outer ends.

Actuation of fluid powered cylinder 114 imparts linear force on extension clevis bracket 113, which acts as a lever, causing mounting cylinder 111 to rotate about its longitudinal axis within mounting bracket 112. As mounting cylinder 111 rotates, mounting block 119 also rotates which, in turn, cause pipe rail member 120 to move up or down relative to trailer frame assembly. In this manner, actuation of fluid powered cylinder 114 can be used to selectively raise and lower any pipe rails 120 connected to mounting cylinder 111. Said pipe support rails 120 can provide a base for selectively directing a pipe section towards or away from trailer frame assembly 10 (and trough member 70) of the present invention.

Figure 10:
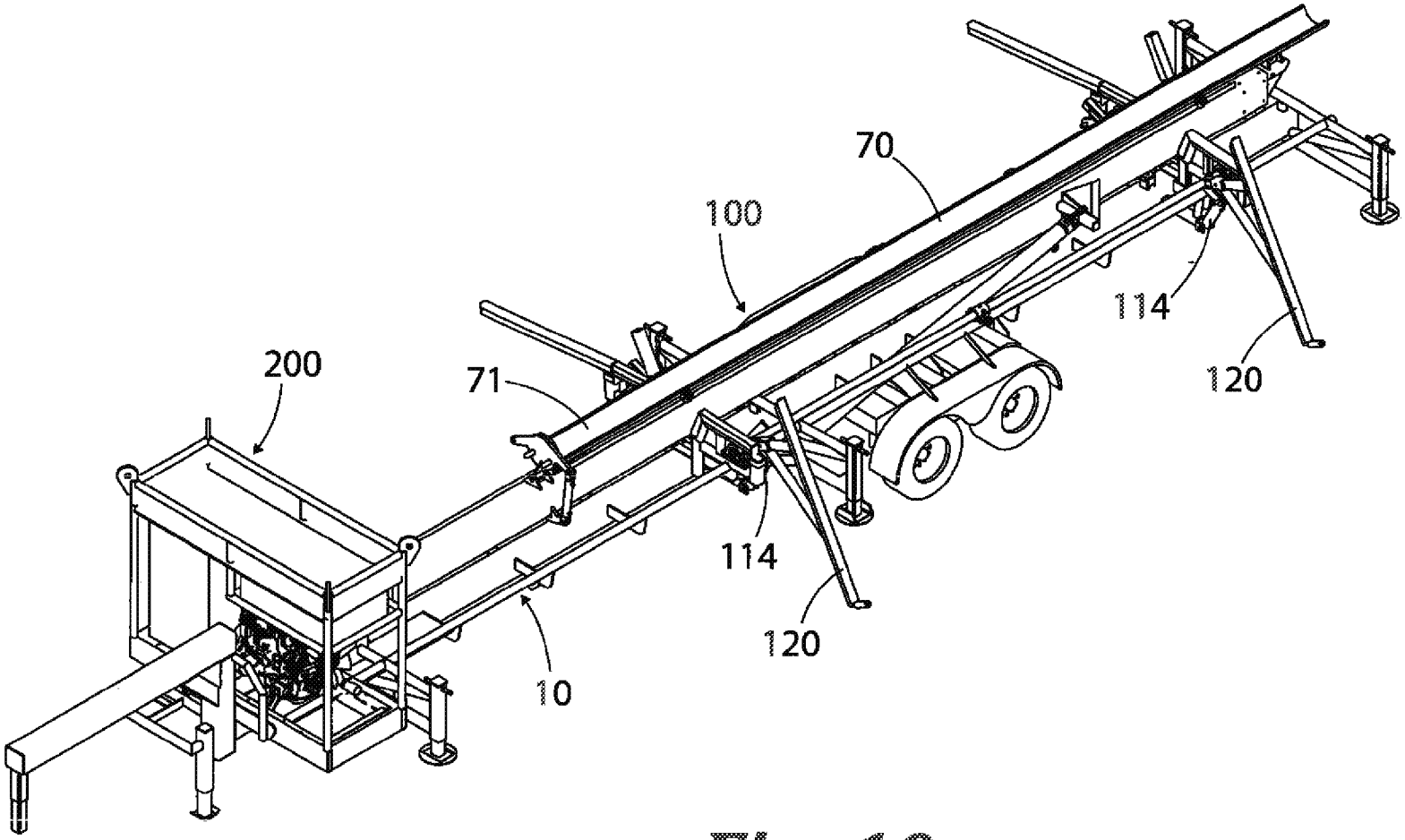
FIG. 10 depicts a side perspective view of the automated pipe pickup and laydown assembly of the present invention, including a power generation component.

FIG. 10 depicts a side perspective view of the automated pipe pickup and laydown assembly 100 of the present invention, including a separate power generator 200. Power source 200 can be selectively secured to trailer frame assembly 10 (such as when transporting, maneuvering or operating said automated pipe pickup and laydown assembly 100), or removed from said trailer frame assembly 10. Further, power source 200 can provide power to said automated pipe pickup and laydown assembly 100 when installed on said trailer frame assembly 10 or, alternatively, when positioned in a different position (that is, a location other than on said trailer frame assembly 10).

Figure 11:
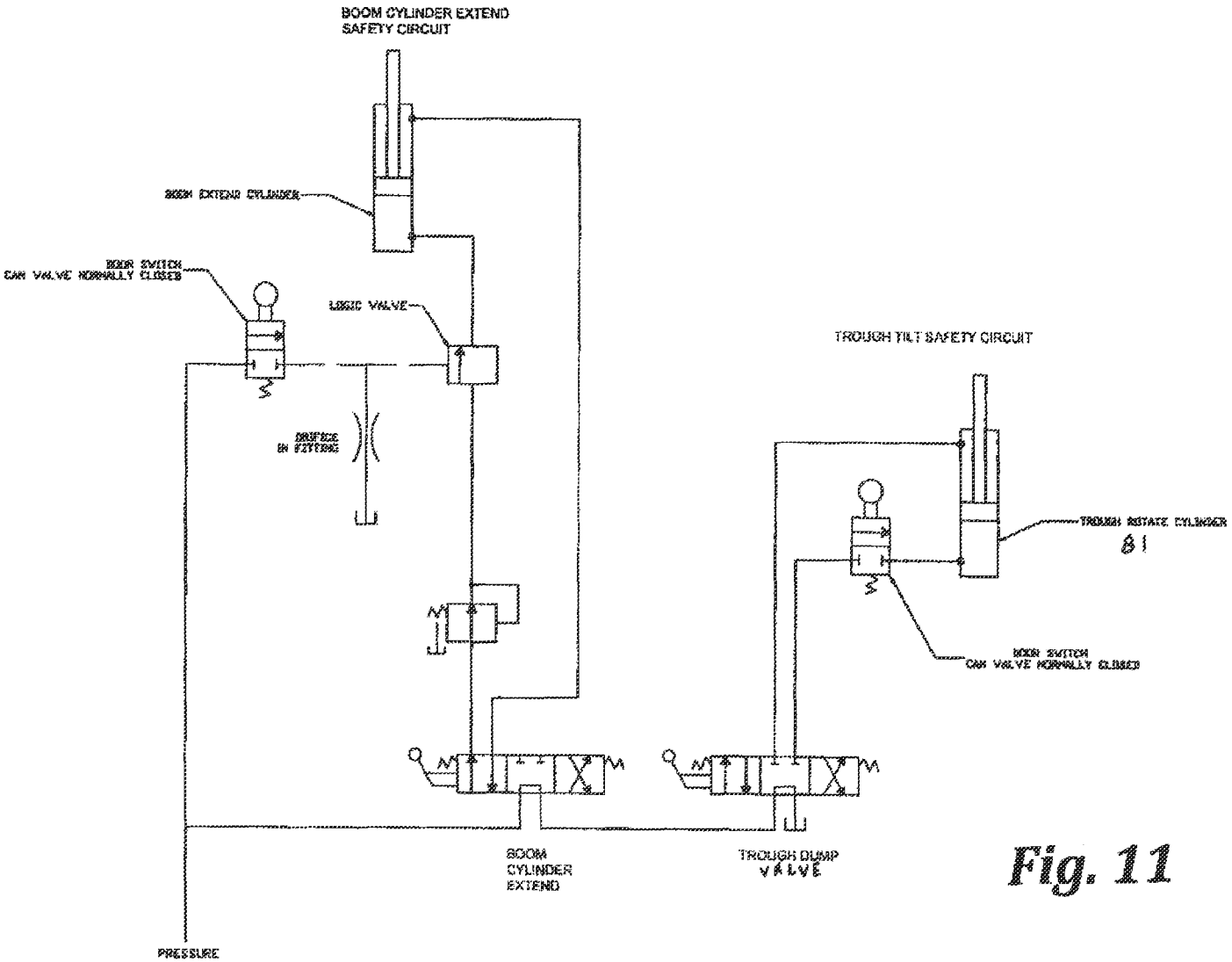
FIG. 11 depicts a schematic illustration depicting a safety system of the automated pipe pickup and laydown assembly of the present invention.

FIG. 11 depicts a schematic illustration depicting a safety system of the automated pipe pickup and laydown assembly of the present invention. Said safety system prevents trough 70 from being rotated from vertical when central beam 50 is elevated off of trailer frame assembly 10.

In operation, said automated pipe pickup and laydown assembly 100 of the present invention comprises a relatively small and light-weight trailer mounted apparatus that can be easily moved to and from remote locations, such as well drilling sites, and positioned in and around said locations. By way of illustration, but not limitation, said automated pipe pickup and laydown assembly 100 can have a height of approximately thirty-eight (38) feet, and a weight limit of approximately 1,200 lbs; however, it is to be observed that pipe pickup and laydown assembly 100 can have different dimensions and weight characteristics without departing from the scope of the present invention.

Once transported to a work site, automated pipe pickup and laydown assembly 100 of the present invention can be positioned in a desired location. In many cases, said automated pipe pickup and laydown assembly 100 will be positioned at or near a pipe rack or other staging area, typically where pipe or other tubular goods are stored, in the vicinity of a drilling rig.

Referring to FIG. 10, in most instances pipe support rails 120 are positioned in a substantially lowered configuration. Personnel and/or other automated equipment (including, without limitation, a fork lift or other similar device) can be used to lift and move a pipe section in proximity to said pipe support rails 120; typically, said rails 120 are oriented substantially perpendicular to the longitudinal axis of said section of pipe. Fluid powered cylinder(s) 114 are thereafter extended, causing pipe rails 120 to raise upward and cooperate to lift and support a section of pipe. Said pipe support rails 120 provide a base for directing a pipe section generally toward trailer frame assembly 10 (and trough member 70) of the present invention. In many instances, when fully extended using fluid powered cylinder(s) 114, said pipe rails 120 are sloped downward in the direction of trough 70.

A section of pipe can be gravity fed or otherwise directed along said raised pipe support rails toward trough member 70. In a preferred embodiment, the proximate end of said pipe support rails 120 are positioned above trough 70, such that said pipe section can be rolled off of said pipe rails 120 and directly into concave surface 71 of trough member 70.

Figure 12:
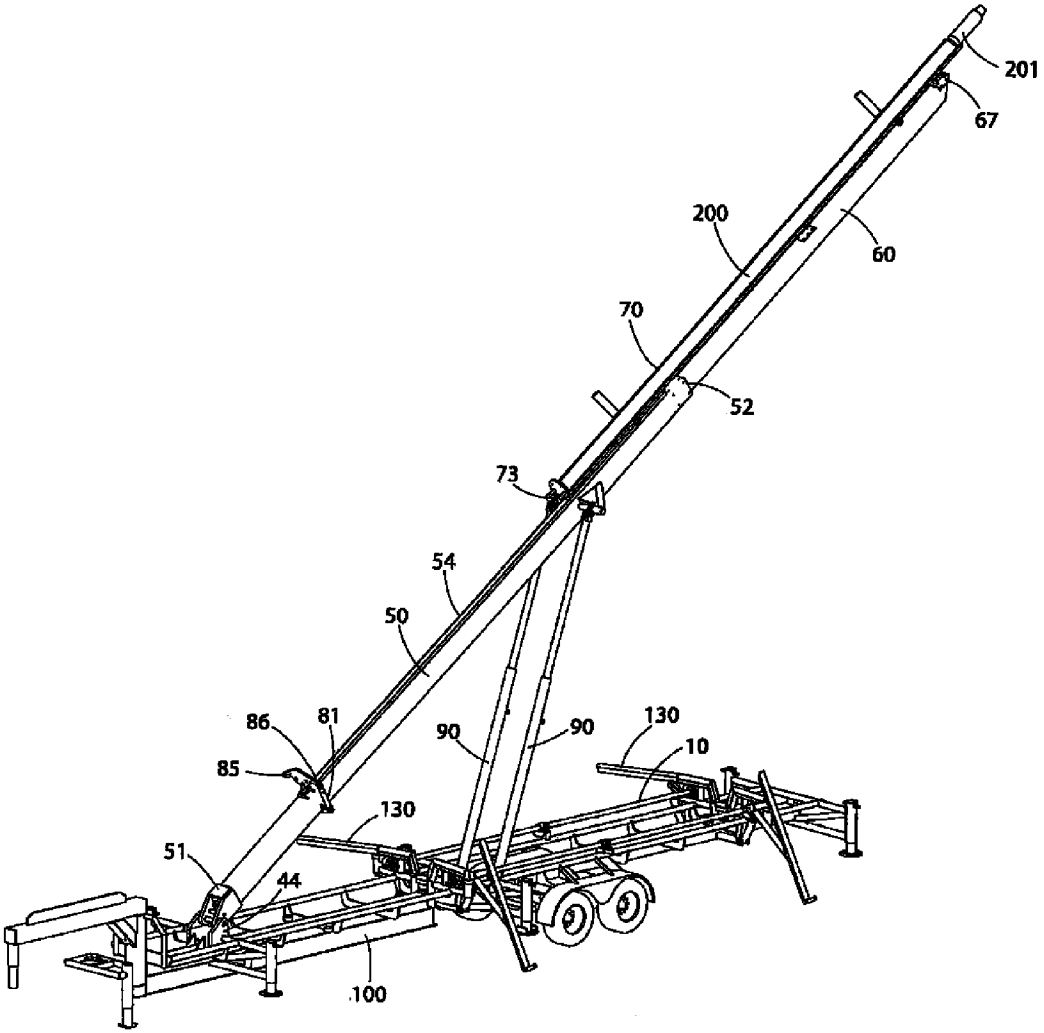
FIG. 12 depicts a side perspective view of the automated pipe pickup and laydown assembly of the present invention in a partially extended configuration and supporting a section of pipe.

FIG. 12 depicts a side perspective view of the automated pipe pickup and laydown assembly of the present invention in a partially extended configuration and supporting a section of pipe 200. After said section of pipe 200 is positioned within trough member 70, fluid powered cylinders 90 can be extended, thereby causing beam mounting collar 51 to pivot about pivot bolt 44 while distal end 52 of central beam member 50 elevates away from trailer frame assembly 10.

In this manner, elevation of central beam member 50 can position distal end 201 of pipe section 200 (located within trough 70) at or near an elevated height of a drilling rig V-door or other rig floor opening. Hydraulic cylinder 61 (not visible in FIG. 12) can be actuated, causing extender beam 60 to telescopically extend relative to said central beam member 50. Trough member 70, operationally attached to trough connection bracket 67, rides within track 54 along the longitudinal axis of central beam member 50 as extender beam 60 telescopes outward. Extension of said extender beam 60 and attached trough 70 further move distal end 201 of said pipe section 200 to a desired position (such as, for example, through a V-door of a drilling rig derrick).

As noted above, a safety system can be employed to prevent trough member 70 from rotating when central beam member 50 is elevated, such as when central beam member 50 is raised off of trailer frame assembly 10. In a preferred embodiment, said safety system comprises a sensor that can determine when said central beam member 50 is elevated relative to said trailer frame assembly 10; although other configurations can be employed without departing from the scope of the present invention, said sensor comprises a "push button" switch mounted to said trailer assembly 10.

Said switch is operationally connected to at least one valve that permits flow of control fluid (such as, for example, hydraulic fluid) that powers dump cylinder 81. As such, when said sensor (switch) recognizes that central beam member 50 is positioned adjacent to trailer assembly 10, said valve is maintained in an open position permitting flow of such control fluid and operation of dump cylinder 81 and, in turn, rotation of trough member 70. However, when said sensor recognizes that central beam member 50 is elevated off of said trailer assembly 10, said sensor/switch closes said at least one valve, thereby preventing flow of such control fluid and actuation of cylinder assembly 81. In this manner, trough member 70 cannot be rotated when central beam member 50 is elevated off of trailer assembly 10.

During pipe laydown operations, the process described above can be repeated in reverse. Specifically, fluid powered cylinders 90 can be extended, thereby causing beam mounting collar 51 to pivot about pivot bolt 44 while distal end 52 of central beam member 50 elevates away from trailer frame assembly 10. Hydraulic cylinder 61 can be actuated, causing extender beam 60 to telescopically extend relative to said central beam member 50. In this manner, distal end 52 of central beam member can position the distal or outer end of trough 70 at or near the height of a drilling rig V-door or other rig floor opening.

In this position, a section of pipe or other tubular good (such as pipe section 200 in FIG. 12) can be easily safely loaded from a rig derrick or other rig lifting mechanism into trough 70. Thereafter, hydraulic cylinder 61 can be retracted, causing extender beam 60 to telescopically retract relative to said central beam member 50. Once fully retracted, fluid powered cylinders 90 can be retracted, thereby causing beam mounting collar 51 to pivot about pivot bolt 44 while distal end 52 of central beam member 50 lowers toward trailer frame assembly 10.

After said central beam 50 has been fully lowered, actuation of fluid powered cylinder 81 imparts linear force on extension member 86 of kicker plate 85, which acts as a lever, causing kicker plate 85 to rotate about pivot bolt 84. Torque forces are, in turn, imparted from said kicker plate 85 to pins 73 (which are received within holes in said kicker plate 85) and attached trough member 70. In this manner, actuation of fluid powered cylinder 81 can be used to selectively rotate said trough member 70 about its longitudinal axis and "dump" the pipe section disposed within trough member 70. Referring to FIG. 12, a section of pipe dumped from trough member 70 can be received on optional receiving rails 130, which are oriented substantially perpendicular to the longitudinal axis of said trough member 70.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for handing pipe and other tubular goods comprising:

a) a trailer;

b) a substantially hollow central beam having a first end, a second and a through bore, wherein said first end of said beam is pivotally connected to said trailer;

c) an extender beam telescopically disposed in said bore of said central beam;

d) a linear actuator having a first end, a second end and a length, wherein said first end is attached to said beam and said second end is attached to said extender beam;

e) a substantially concave trough member having a first end and a second end, wherein said first end of said trough member is attached to said extender beam and said second end of said trough is moveably disposed along a portion of the length of said beam;

f) a dump assembly for selectively rotating said trough member about its longitudinal axis, wherein said dump assembly comprises;

i) a plate member having at least one lateral extension, wherein said plate member is operationally connected to said trough member and oriented substantially parallel to said longitudinal axis of said trough member;

ii) a linear actuator having a first end and a second end, wherein said first end is connected to said lateral extension and said second end is connected to a surface other than said plate member; and iii) at least one bolt attached to said trough member, wherein said at least one bolt is slidably received within a bore in said plate member when said extender beam is fully retracted.

2. The apparatus of claim 1, further comprising a system for preventing rotation of said trough member when said central beam member is separated from said trailer, wherein said system for preventing rotation of said trough member further comprises:

a) a sensor adapted to sense when said central beam member is separated from said trailer; and b) a valve operationally connected to said sensor, wherein said valve prevents operation of said linear actuator of said trough dump assembly when said sensor senses that central beam member is separated from said trailer.

3. An apparatus for handing pipe and other tubular goods comprising:

a) a base;

b) a substantially hollow central beam having a first end, a second and a through bore, wherein said first end of said beam is pivotally connected to said base;

c) an extender beam telescopically disposed in said bore of said central beam;

d) a linear actuator having a first end, a second end and a length, wherein said first end is attached to said beam and said second end is attached to said extender beam;

e) a substantially concave trough member having a first end and a second end, wherein said first end of said trough member is attached to said extender beam and said second end of said trough is moveably disposed along a portion of the length of said beam;

f) a dump assembly adapted to selectively rotate said trough member about its longitudinal axis;

g) an assembly adapted to prevent rotation of said trough member when said central beam member is separated from said base comprising:

i) a sensor adapted to sense when said central beam member is separated from said base; and ii) a valve operationally connected to said sensor, wherein said valve prevents operation of said trough dump assembly when said sensor senses that central beam member is separated from said base.

* * * * *